US008920583B2

(12) United States Patent
Asahi et al.

(10) Patent No.: US 8,920,583 B2
(45) **Date of Patent: *Dec. 30, 2014**

(54) STEEL PIPE EXCELLENT IN DEFORMATION CHARACTERISTICS AND METHOD OF PRODUCING THE SAME

(75) Inventors: Hitoshi Asahi, Tokyo (JP); Tetsuo Ishitsuka, Tokyo (JP); Motofumi Koyuba, Tokyo (JP); Toshiyuki Ogata, Tokyo (JP)

(73) Assignee: Nippon Steel & Sumitomo Metal Corporation, Tokyo (JP)

( * ) Notice: Subject to any disclaimer, the term of this patent is extended or adjusted under 35 U.S.C. 154(b) by 739 days.

This patent is subject to a terminal disclaimer.

(21) Appl. No.: 12/452,765

(22) PCT Filed: Jul. 22, 2008

(86) PCT No.: PCT/JP2008/063475

§ 371 (c)(1), (2), (4) Date: Jan. 20, 2010

(87) PCT Pub. No.: WO2009/014238

PCT Pub. Date: Jan. 29, 2009

(65) Prior Publication Data

US 2010/0119860 A1 May 13, 2010

(30) Foreign Application Priority Data

Jul. 23, 2007 (JP) ..... 2007-190874
Jan. 16, 2008 (JP) ..... 2008-007108

(51) Int. Cl.

| | |
|---|---|
| ***B32B 1/08*** | (2006.01) |
| ***C22C 38/58*** | (2006.01) |
| ***C22C 38/42*** | (2006.01) |
| ***C22C 38/54*** | (2006.01) |
| ***C22C 38/04*** | (2006.01) |
| ***C21D 9/08*** | (2006.01) |
| ***C21D 8/10*** | (2006.01) |

(52) U.S. Cl.

CPC . *C22C 38/04* (2013.01); *C21D 9/08* (2013.01); *C21D 8/105* (2013.01)

USPC ..... 148/335; 148/519; 148/332; 148/547

(58) Field of Classification Search

USPC ..... 148/520, 593

See application file for complete search history.

(56) References Cited

U.S. PATENT DOCUMENTS 8,002,910 B2 * 8/2011 Tivelli et al. ..... 148/335
8,110,292 B2 * 2/2012 Fujishiro et al. ..... 428/683

(Continued)

FOREIGN PATENT DOCUMENTS

CN 1924060 3/2007
JP 5-214486 8/1993

(Continued)

OTHER PUBLICATIONS

Japanese Office Action dated Feb. 9, 2010 issued in corresponding Japanese Application No. 2009-524534.

(Continued)

*Primary Examiner* — Roy King
*Assistant Examiner* — Xiaowei Su
(74) *Attorney, Agent, or Firm* — Kenyon & Kenyon LLP

(57) ABSTRACT

The invention provides a steel pipe excellent in deformation characteristics, most notably a steel pipe for expandable-pipe oil well and a low-yield-ratio line pipe, and a method of producing the same without conducting water cooling requiring large-scale heat treatment equipment, namely a method of producing a steel pipe excellent in deformation characteristics whose microstructure is a two-phase structure including a martensite-austenite constituent at an area fraction of 2 to 10% and a soft phase, which method comprises: heating at $Ac_1$+10° C. to $Ac_1$+60° C. and thereafter cooling a precursor steel pipe which contains, in mass %, C: 0.04 to 0.10% and Mn: 1.00 to 2.50%, is limited to Si: 0.80% or less, P: 0.03% or less, S: 0.01% or less, Al: 0.10% or less and N: 0.01% or less, further contains one or more of Ni: 1.00% or less, Mo: 0.60% or less, Cr: 1.00% or less and Cu: 1.00% or less, where content of Mn and content of one or more of Cr, Ni, Mo and Cu satisfy Mn+Cr+Ni+2Mo+Cu≥2.00, and a balance of iron and unavoidable impurities.

1 Claim, 1 Drawing Sheet

(56) References Cited

U.S. PATENT DOCUMENTS

| | | | | |
|---|---|---|---|---|
| 2007/0116975 | A1* | 5/2007 | Yamazaki et al. | 428/544 |
| 2008/0286504 | A1* | 11/2008 | Asahi et al. | 428/34.1 |
| 2009/0297872 | A1* | 12/2009 | Takahashi et al. | 428/586 |

FOREIGN PATENT DOCUMENTS

| | | | | |
|---|---|---|---|---|
| JP | 8-239732 | | 9/1996 | |
| JP | 11-343542 | | 12/1999 | |
| JP | 2004-124228 | | 4/2004 | |
| JP | 2005-60839 | | 3/2005 | |
| JP | 2006-289482 | | 10/2006 | |
| JP | 2006-299415 | | 11/2006 | |
| JP | 3888279 | | 12/2006 | |
| JP | 2007-177266 | | 7/2007 | |
| WO | WO2005038067 | * | 4/2005 | 428/544 |
| WO | WO 2005/080621 | | 9/2005 | |
| WO | WO 2006098198 | A1 * | 9/2006 | |
| WO | WO 2006/132441 | | 12/2006 | |
| WO | WO 2007/013503 | | 2/2007 | |

OTHER PUBLICATIONS

Chinese Office Action dated Nov. 10, 2010 issued in corresponding Chinese Application No. 2008-80025476.3.

International Search Report dated Oct. 28, 2008 issued in corresponding PCT Application No. PCT/JP2008/063475.

Asahi et al., Development and commercialization of high-strength linepipe, Pipeline Technology Conference, Ostend, Oct. 12-14, 2009, pp. 1-12.

* cited by examiner

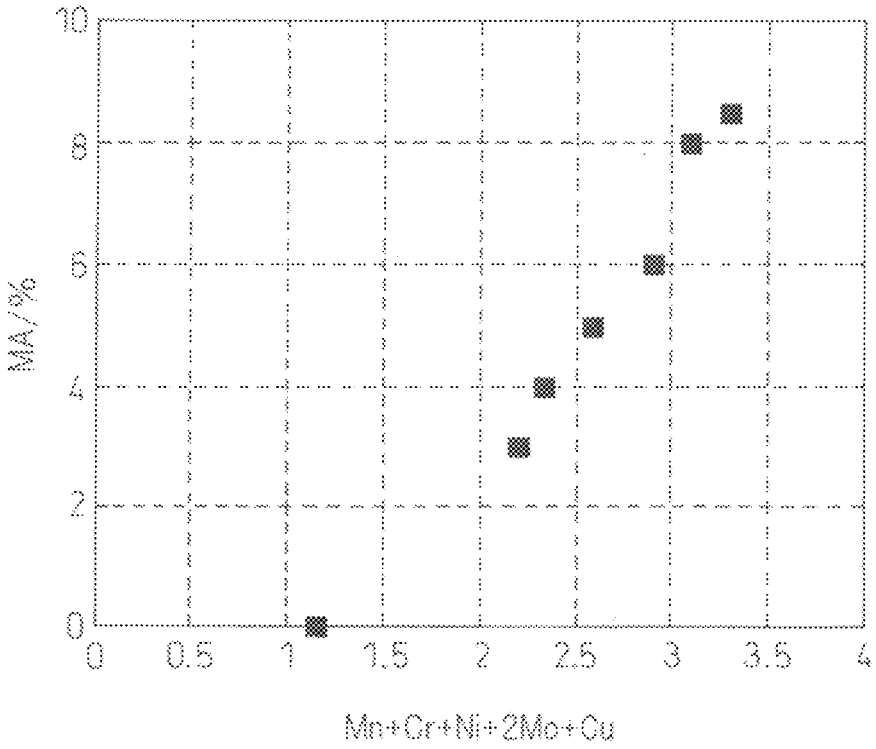
10
8
6
4
2
0
MA/%
0
0.5
1
1.5
2
2.5
3
3.5
4
Mn+Cr+Ni+2Mo+Cu

STEEL PIPE EXCELLENT IN DEFORMATION CHARACTERISTICS AND METHOD OF PRODUCING THE SAME

This application is a national stage application of International Application No. PCT/JP2008/063475, filed 22 Jul. 2008, which claims priority to Japanese Application Nos. 2007-190874, filed 23, Jul. 2007; and 2008-007108, filed 16 Jan. 2008, each of which is incorporated by reference in its entirety.

FIELD OF THE INVENTION

This invention relates to a steel pipe excellent in deformation characteristics, e.g., an oil-well steel pipe for expandable tubular applications that is excellent in expansion characteristics and suitable for use as an expandable oil-well pipe to be expanded after insertion into the well when drilling an oil well or gas well or an electric-resistance-welded line pipe with low yield ratio in the pipe longitudinal direction and suitable for a submarine pipeline laid using a reel barge, a method of producing the same, and a method of producing a precursor steel pipe for the steel pipe excellent in deformation characteristics.

DESCRIPTION OF THE RELATED ART

Steel pipe for use in oil wells has conventionally been used by running it down the well in its form as manufactured. However, recent years have seen the development of a technology for use at the time of drilling an oil well or gas well that enables a steel pipe to be inserted into the well and then expanded inside the well ("expandable-pipe oil well"). This technology is making a major contribution to oil well and gas well development cost reduction.

In the early stage of expandable-pipe oil well development, the steel pipe was expanded about 10% and an ordinary oil-well pipe was used as the expandable-pipe for the expandable-pipe oil well. However, as higher pipe expansion ratios were applied and came to exceed 20%, increase in thickness unevenness became an issue. In other words, unevenness in the thickness of the expandable pipe used in the expandable-pipe oil well led to local wall thickness loss that degraded the performance of the steel pipe and led to fracture and other problems. This placed a limit on the pipe expansion ratio.

The inventors earlier developed steel pipes excellent in expansion characteristics that can be used in expandable-pipe oil wells (see, for example, International Publications WO2005/080621 and WO2006/132441). The steel pipe taught by International Publication WO2005/080621 has a two-phase structure of fine martensite dispersed in a ferrite structure and is excellent in pipe expandability. The steel pipe having a two-phase structure is low in yield strength and high in work hardening. As a result, the stress required for pipe expansion is low, so that the steel pipe has excellent expansion characteristics in the point of not readily experiencing local contraction.

The steel pipe taught by International Publication WO2006/132441 has a composition with limited carbon content and a structure of tempered martensite. It is therefore high in toughness and excellent in expansion characteristics. However, these steel pipes having a two-phase structure of fine martensite dispersed in ferrite structure or a tempered martensite structure are produced by quenching. They therefore require large-scale heat treatment equipment for heating and water cooling the steel pipe.

Moreover, the design concept of line pipes is changing from one based on strength standards to one based on strain standards. As a result, low yield ratio in the longitudinal direction of the pipe has become necessary. This is aimed at preventing local buckling when stress occurs in the pipeline owing to ground movement after installation. On the other hand, when a pipeline is laid on the sea bottom, the reel barge method is used in which the line pipe is once reeled into a coil and then unreeled onto the seabed. Therefore, in order to avoid buckling during the reeling and unreeling, the line pipe needs to have high deformability, i.e., low yield ratio, in the longitudinal direction.

As the quality of the electric-resistance welds of electric-resistance-welded steel pipes has improved in recent years, electric-resistance-welded steel pipes have come into wide use in line pipe applications because they are lower in cost than seamless steel pipes and UO steel pipes. However, an electric-resistance-welded steel pipe generally has high yield ratio since it is used as cold formed from hot coil. The yield ratio of a steel pipe having a large ratio of wall thickness to outside diameter, such as one used in a submarine pipeline, is especially high because its cold-working strain increases in proportion as the thickness/diameter ratio is greater. And resistance reduction in the pipe longitudinal direction by the Bauschinger effect cannot be expected because the steel pipe experiences substantially no compressive stress load during formation.

Many techniques for reducing yield ratio in the longitudinal direction of an electric-resistance-welded steel pipe have been developed (see, for example, Japanese Patent Publication (A) No. 2006-299415). These techniques focus on reducing beforehand the yield ratio of the hot coil that is the steel pipe starting material. Actually, however, the yield ratio of the starting material, no matter how far it is reduced, has substantially no effect on the yield ratio of the formed pipe because resistance is markedly increased by the work hardening during pipe forming.

Techniques have also been developed that use the Bauschinger effect to lower resistance by imparting compressive strain in the longitudinal direction during the sizing process after pipe making (see, for example, Japanese Patent Publication (A) No. 2006-289482). In industrial production, however, it is extremely difficult to impart longitudinal compressive strain without buckling the steel pipe.

And while not for application to pipe line, there have also been developed methods for producing low yield ratio electric-resistance-welded steel pipe for construction use by heat treatment after pipe making (see, for example, Japanese Patent No. 3888279). However, these techniques cannot provide the high level strength, toughness and weldability required by line pipe.

SUMMARY OF THE INVENTION

As pointed out in the foregoing, conventional steel pipes that rely on a two-phase structure of fine martensite dispersed in ferrite structure or a tempered martensite structure to achieve excellent deformation characteristics require quenching and other heat treatment after pipe forming. This makes large-scale heat treatment equipment necessary. And when production of steel pipe with low yield ratio in the longitudinal direction and excellent deformation characteristics is attempted by the method of using a hot coil with low yield ratio or the method of imparting compressive stress in the pipe longitudinal direction, it is in fact found to be impossible to achieve the desired low yield ratio. Further, while the method of applying heat treatment after pipe making can achieve low yield ratio, a technique for securing the characteristics required by line pipe is required. Therefore, production of line pipe having a low yield ratio in the longitudinal direction is difficult, particularly in the case of electric-resistance-welded steel pipe.

The present invention utilizes simple heat treatment without need for water cooling requiring large-scale heat treatment equipment to provide a steel pipe excellent in deformation characteristics, e.g., an oil-well steel pipe for expandable tubular applications that is excellent in expansion characteristics or a line pipe with low yield ratio in the pipe longitudinal direction, a method of producing the same, and a method of producing a precursor steel pipe (a pipe before heat treatment) for the steel pipe excellent in deformation characteristics.

For improving deformation characteristics, specifically for enhancing expansion characteristics and lowering yield ratio, it is effective to increase the work-hardening coefficient. The inventors therefore concluded that it was necessary to adopt as the steel pipe structure a two-phase structure comprising a soft phase and a hard second phase. When heat treatment is performed for obtaining such a two-phase structure, water cooling for obtaining the hard phase requires use of large-scale heat treatment equipment. So it is desirable for the low yield ratio to be obtainable even by air cooling. However, owing to the fact that the cooling rate by air cooling is slower than that by water cooling, the portion transformed to austenite during heating of the steel pipe to the two-phase region decomposes into ferrite and cementite during the air cooling, making it difficult to obtain martensite or bainite as a hard second phase.

Upon considering this problem, the inventors figured that if a martensite-austenite constituent (sometimes called MA in the following), which is obtainable even at a relatively slow cooling rate, should be used as the hard second phase, it might be possible to obtain a steel pipe having a two-phase structure with high work hardening even by air cooling. Through studies conducted in line with this conjecture they discovered that a two-phase structure comprising a soft phase and a hard second phase with a high work-hardening coefficient can be obtained even by air cooling conducted after heat treatment, provided that the chemical constituents of the steel pipe are regulated to suitable ranges and the heating is performed at an appropriate temperature.

This invention was achieved based on this knowledge and the gist thereof is as set out below.

(1) A steel pipe excellent in deformation characteristics which contains, in mass %, C: 0.04 to 0.10% and Mn: 1.00 to 2.50%, is limited to Si: 0.80% or less, P: 0.03% or less, S: 0.01% or less, Al: 0.10% or less and N: 0.01% or less, further contains one or more of Ni: 1.00% or less, Mo: 0.60% or less, Cr: 1.00% or less and Cu: 1.00% or less, where content of Mn and content of one or more of Cr, Ni, Mo and Cu satisfy $$Mn+Cr+Ni+2Mo+Cu \geq 2.00,$$

and a balance of iron and unavoidable impurities, and whose microstructure is a two-phase structure including a martensite-austenite constituent at an area fraction of 2 to 10% and a soft phase.

(2) A steel pipe excellent in deformation characteristics according to (1), wherein the soft phase is one or more of ferrite, high-temperature tempered martensite, and high-temperature tempered bainite.

(3) A steel pipe excellent in deformation characteristics according to (1) or (2), further containing, in mass %, one or more of Nb: 0.01 to 0.30%, Ti: 0.005 to 0.03%, V: 0.30% or less, B: 0.0003 to 0.003%, Ca: 0.01% or less, and REM: 0.02% or less.

(4) A steel pipe excellent in deformation characteristics according to any of (1) to (3), wherein a work-hardening coefficient in the circumferential direction of the steel pipe is 0.10 or greater.

(5) A steel pipe excellent in deformation characteristics according to any of (1) to (4), wherein the steel pipe has a ratio of wall thickness to outside diameter of 0.03 or greater.

(6) A steel pipe excellent in deformation characteristics according to any of (1) to (5), wherein the wall thickness of the steel pipe is 5 to 20 mm.

(7) A steel pipe excellent in deformation characteristics according to any of (1) to (6), wherein the outside diameter of the steel pipe is 114 to 610 mm.

(8) A steel oil-well pipe for expandable-pipe oil well comprising a steel pipe excellent in deformation characteristics according to any of (1) to (7), which steel oil pipe for expandable-pipe oil well is to be expanded in a well and whose steel pipe has a wall thickness of 5 to 15 mm and an outside diameter of 114 to 331 mm.

(9) A line pipe comprising a steel pipe excellent in deformation characteristics according to any of (1) to (7), whose steel pipe has a wall thickness of 5 to 20 mm and an outside diameter of 114 to 610 mm.

(10) A method of producing a steel pipe excellent in deformation characteristics whose microstructure is a two-phase structure including a martensite-austenite constituent at an area fraction of 2 to 10% and a soft phase, which method comprises:

heating at $Ac_1$+10° C. to $Ac_1$+60° C. and thereafter cooling a precursor steel pipe which contains, in mass %, C: 0.04 to 0.10% and Mn: 1.00 to 2.50%, is limited to Si: 0.80% or less, P: 0.03% or less, S: 0.01% or less, Al: 0.10% or less and N: 0.01% or less, further contains one or more of Ni: 1.00% or less, Mo: 0.60% or less, Cr: 1.00% or less and Cu: 1.00% or less, where content of Mn and content of one or more of Cr, Ni, Mo and Cu satisfy $$Mn+Cr+Ni+2Mo+Cu \geq 2.00,$$

and a balance of iron and unavoidable impurities.

(11) A method of producing a steel pipe excellent in deformation characteristics according to (10), wherein the precursor steel pipe further contains in mass %, one or more of Nb: 0.01 to 0.30%, Ti: 0.0.05 to 0.03%, V: 0.30% or less, B: 0.0003 to 0.003%, Ca: 0.01% or less, and REM: 0.02% or less.

(12) A method of producing a precursor steel pipe for a steel pipe excellent in deformation characteristics according to claim 10 or 11, wherein the method further comprising the steps of:

heating at 1000° C. to 1270° C. a slab containing the chemical compositions claimed in claim 10 or 11, hot rolling the heated slab to a finish rolling reduction of 50% or greater;

forming the obtained steel plate into an open pipe shape; and welding the seam.

(13) A method of producing a precursor steel pipe for a steel pipe excellent in deformation characteristics according to (12), wherein the slab further contains, in mass %, one or more of Nb: 0.01 to 0.30%, Ti: 0.005 to 0.03%, V: 0.30% or less, B: 0.0003 to 0.003%, Ca: 0.01% or less, and REM: 0.02% or less.

The present invention enables production of a steel pipe excellent in deformation characteristics, e.g., an oil well steel pipe for expandable tubular applications that is excellent in expansion characteristics or a line pipe with low yield ratio, utilizing air cooling after pipe heating, without need for large-scale heat treatment equipment for heating and water cooling the steel pipe.

BRIEF DESCRIPTION OF THE DRAWINGS

FIG. 1 is a diagram showing how the MA content of the air-cooled steel pipe varies with the amount of added Mn, Ca, Ni, Mo and Cu.

DETAILED DESCRIPTION OF THE INVENTION

The inventors conducted a study on methods for producing steel pipes that have a two-phase structure comprising a soft phase and a hard second phase and are excellent deformation characteristics, with particular focus on methods for producing high-strength steel pipe excellent in expansion characteristics and line pipe with low yield ratio by air cooling a steel pipe after heating it throughout.

When a steel increased in hardenability and containing elements not readily soluble in cementite is heated to the two-phase region between the $Ac_1$ transformation temperature and the $Ac_3$ transformation temperature, the austenite formed tends during air cooling to become MA (martensite-austenite constituent), without decomposing into carbide and ferrite. Elements that have this effect include Mn, Cr, Ni, Mo and Cu.

The inventors therefore investigated how the amount of MA formed after heating to the two-phase region and air cooling varies with the amount of added Mn, Cr, Ni, Mo and Cu. Specifically, they produced steel plates by incorporating various amounts of Ni, Mo, Cr and Cu into steel with a basic composition of, in mass %, C: 0.04 to 0.10%, Mn: 1.40 to 2.50%, Si: 0.80% or less, P: 0.03% or less, S: 0.01% or less, Al: 0.10% or less and N: 0.01% or less. The plates were heat treated by heating to 700 to 800° C. and air cooling.

Samples for microstructure observation were taken from the plates after heat treatment, leveled by etching, and observed with a light microscope. The structures were photographed. The white colored regions in the microstructure photographs were identified as MA and the area fractions of the regions were determined by image analysis. Specimens taken from the plates were tensile-tested, a log-log graph of true strain vs true stress was prepared, and the work-hardening coefficient (n value) was determined from the slope of the linear section. The tensile strengths of the plates were between 600 and 800 MPa.

It was found that when the heating temperature is less than $Ac_1$+10° C., the n value becomes less than 0.1. This is because only a small amount of austenite is formed during the heating so that the amount of MA formed after air cooling is also small. On the other hand, although heating at a temperature greater than $Ac_1$+60° C. increases the amount of austenite formed, the amount of C distributed in the austenite decreases. The austenite therefore becomes unstable and decomposes into ferrite and cementite during air cooling. As a result, the MA area fraction declines, so that, as in the case of heating at a low temperature, the n value becomes less than 0.1.

These findings prompted the inventors to analyze how the MA content of a steel pipe air cooled after heating in the temperature range of $Ac_1$+10° C. to $Ac_1$+60° C. varies with the amount of Mn, Cr, Ni, Mo and Cu addition. As shown in FIG. 1, the analysis showed that the MA content can be correlated to Mn+Cr+Ni+2Mo+Cu as an index. When any of Cr, Ni, Mo and Cu is intentionally omitted from among the selected elements, Mn+Cr+Ni+2Mo+Cu is calculated using 0 as the value of the omitted element or elements.

$Ac_1$ is calculated based on the contents (mass %) of Si, Mn, Ni and Cr among the steel constituents as:

$$Ac_1=723+29.1\times Si-10.7\times Mn-16.9\times(Ni—Cr).$$

When any among the deoxidizing element Si and the optional elements Ni and Cr are intentionally omitted, $Ac_1$ is calculated using 0 as the value of the omitted element or elements.

In the graph of FIG. 1, "MA" scaled on the vertical axis is the area fraction of MA. As will be understood from the explanation that follows, the MA area fraction becomes 2% or greater when Mn+Cr+Ni+2Mo+Cu is 2.00 or greater. The MA area fraction increases with increasing value of Mn+Cr+Ni+2Mo+Cu. The reason for this is thought to be that the improving stability of austenite with increasing value of Mn+Cr+Ni+2Mo+Cu increases the amount remaining as MA after air cooling.

The inventors further produced hot-rolled steel plates based on steel plate chemical compositions for establishing MA area fractions of 2 to 10% and work-hardening coefficients of 0.10 or greater. The plates were formed into electric-resistance-welded steel pipes. Each steel pipe was heated in the temperature range of $Ac_1$+20° C. to $Ac_1$+60° C., air cooled, and expanded by forcing a pipe expansion plug into one end, whereafter the limit pipe expansion ratio up to which no cracking occurred was determined. Specimens taken along the circumference of the pipes were tensile-tested to determine their work-hardening coefficients. The limit pipe expansion ratio was found to be 20% or greater when the work-hardening coefficient was 0.10 or greater and to be 30% or greater when the work-hardening coefficient was 0.15 or greater.

Similarly, steel plates were produced by incorporating various amounts of Ni, Mo, Cr and Cu into steel with a basic composition of, in mass %, C: 0.04 to 0.10%, Mn: 1.00 to 2.50%, Si: 0.80% or less, P: 0.030% or less, S: 0.010% or less, Al: 0.10% or less and N: 0.010% or less. The plates were pre-strained at a rate equivalent to pipe forming strain of 4% and heat treated by heating to 700 to 800° C. and air cooling. Samples for microstructure observation taken from the plates after heat treatment were observed with a light microscope and their MA area fractions were determined by image analysis.

The yield ratio of the pre-strained steel plates was 0.92. MA formation after air cooling was low when the heating temperature was less than $Ac_1$+10° C. When it exceeded $Ac_1$+60° C., the austenite decomposed into ferrite and cementite during air cooling. In either case, the MA area fraction declined and the yield ratio decreased only to around 0.90.

A total of 27 types of steel varied in composition within the ranges of Mn: 1.00 to 2.5%, Cr: 0 to 1.0%, Ni: 0 to 1.0%, Mo: 0 to 0.6% and Cu: 0 to 1.0% were prepared, heated in the temperature range of $Ac_1$+10° C. to $Ac_1$+60° C., and variation of the MA content of air-cooled, pre-strained steel plates with the amounts of added Mn, Cr, Ni, Mo and Cu was analyzed. Multiple regression analysis of the results showed that the best correlation with MA content is obtained when Mn+Cr+Ni+2Mo+Cu is used as an index.

That is, it was found that, as seen in FIG. 1, the amount of MA can be correlated to Mn+Cr+Ni+2Mo+Cu as an index. All heating temperatures within the temperature range of $Ac_1$+10° C. to $Ac_1$+60° C. gave results similar to those in FIG. 1. The inventors further produced hot-rolled steel plate using steels of compositions for achieving MA area fractions of 2 to 10% by the aforesaid heat treatment and formed them into pipes having a ratio of wall thickness to outside diameter of 0.05. The pipes were heated, air cooled, and specimens taken along the circumference of the pipes were tensile-tested to determine their work-hardening coefficients. It was found that when the heating temperature is in the range of $Ac_1$+10° C. to $Ac_1$+60° C., MA is 2% or greater, so that yield ratio falls to 0.90 or less.

The chemical composition of the steel pipe excellent in deformation characteristics according to the present invention and the reasons for limiting the constituents thereof are explained in the following. The chemical composition of the invention steel pipe is defined within the following ranges from both the viewpoint of the structure and strength of the steel plate before pipe making and the viewpoint of the structure and strength of the pipe after heat treatment.

C stabilizes austenite during heating at $Ac_1$+10° C. to $Ac_1$+60° C., preferably $Ac_1$+20° C. to $Ac_1$+60° C., and as such is an extremely important element in the present invention for increasing MA area fraction after air cooling. C must be added to a content of 0.04% or greater to secure the desired amount of MA after heat treatment. C is also an element that improves steel strength by enhancing hardenability. Since excessive addition degrades toughness by increasing strength too much, the upper limit of C addition is defined as 0.10%. The more preferable upper limit of C content is less than 0.10%.

Mn is an indispensable element for increasing hardenability and securing high strength. It is also an element that stabilizes austenite by lowering the $Ac_1$ point. However, Mn must be added to a content of 1.00% or greater so that MA decomposition after air cooling can be inhibited by forming austenite during heating at $Ac_1$+10° C. to $Ac_1$+60° C., preferably $Ac_1$+20° C. to $Ac_1$+60° C. The lower limit of Mn content is preferably 1.40% or greater. However, when the Mn content is too high, the martensite content of the steel plate from which the steel pipe is fabricated becomes excessive. As this degrades formability by making strength too high, the upper limit of Mn content is defined as 2.50%.

Si is a deoxidizing element that markedly degrades low-temperature toughness when a large amount is added. The upper limit of Si content is therefore defined as 0.80%. In this invention, Al and Ti can also be used as steel deoxidizers, so addition of Si is not absolutely necessary. However, as Si improves strength and promotes MA formation, it is added to a content of 0.10% or greater.

P and S are impurities whose upper limits are defined as 0.03% and 0.01%, respectively. P content reduction alleviates center segregation of the continuously cast slab, thereby preventing intergranular fracture and improving toughness. S content reduction works to improve ductility and toughness by reducing MnS that elongates during hot rolling.

Al is a deoxidizing element. When added to a content of greater than 0.10%, it increases nonmetallic inclusions that impair the steel cleanliness. The upper limit of Al content is therefore defined as 0.10%. When Ti and Si are used as deoxidizers, Al addition is not absolutely necessary, so no lower limit of Al content is defined. But Al is usually present as an impurity at a content of 0.001% or greater. When AlN is utilized for steel structure refinement, Al is preferably added to a content of 0.01% or greater.

N is an impurity whose upper limit is defined as 0.01% or less. In the case of optionally adding Ti, if N is incorporated at a content of 0.001% or greater, TiN forms to suppress austenite grain coarsening during slab reheating, thereby improving base material toughness. But when N content exceeds 0.01%, TiN coarsens and gives rise to surface flaws, toughness degradation and other adverse effects.

When, as mentioned above, one or more of Ni, Mo, Cr and Cu are added in addition to the required element Mn so as to satisfy $$Mn+Cr+Ni+2Mo+Cu \geq 2.00,$$

the desired amount of MA can be secured because austenite does not readily decompose into ferrite and cementite during air cooling. In the expression above, Mn, Cr, Ni, Mo and Cu represent the contents (mass %) of the respective elements. When addition of any of the optional elements Cr, Ni, Mo and Cu is intentionally omitted, the left side of the expression is calculated using 0 as the value of the omitted element or elements.

Moreover, Ni, Mo, Cr and Cu are elements that improve hardenability, so that one or more of them are preferably added to realize high strength.

Ni is also effective for finely forming austenite during heating of the steel in the two-phase region. But addition of too much Ni makes the martensite content of the steel plate from which the pipe is fabricated excessive. As this degrades formability by making strength too high, the upper limit of Ni content is preferably defined as 1.00%.

When Mo, Cr and Cu are excessively added, hardenability increases. As this may degrade formability by making the strength of the steel plate from which the pipe is fabricated too high, the upper limits of Mo, Cr and Cu addition are preferably defined as 0.60%, 1.00% and 1.00%, respectively.

One or more of Nb, Ti, V, B, Ca and REM can be further added. Nb, Ti and V contribute to steel structure refinement, B contributes to hardenability improvement, and Ca and REM contribute to inclusion morphology control.

Nb is an element that inhibits recrystallization of austenite during rolling. Addition of Nb to a content of 0.01% or greater is preferable for refining the grain diameter of the steel before heating. Nb is also preferably added for securing the toughness required by a line pipe. But addition of Nb in excess of 0.30% degrades toughness, so the upper limit of addition is preferably defined as 0.30%.

Ti is an element that forms fine TiN, thereby inhibiting austenite grain coarsening during slab reheating. And when Al content low, e.g., 0.005% or less, Ti functions as a deoxidizer.

For improving toughness by refining the microstructure utilizing Ti addition, N is preferably incorporated at a content of 0.001% or greater and Ti added to a content of 0.005% or greater. But when the Ti content is too great, toughness deteriorates owing to TiN coarsening and/or TiC-induced precipitation hardening. The upper limit of Ti addition is therefore preferably defined as 0.03%.

V has substantially the same effects as Nb but at a somewhat weaker level. For enabling V to exhibit its effects, the element is preferably added to a content of 0.01% or greater. But as excessive V addition degrades toughness, the upper limit of V addition is preferably defined as 0.30%.

B is an element that increases steel hardenability and promotes MA formation by inhibiting decomposition of austenite into ferrite and carbide during air cooling. For obtaining these effects, B is preferably added to a content of 0.0003% or greater. However, addition of B in excess of 0.003% may cause loss of toughness owing to formation of coarse B-containing carbides. The upper limit of B addition is therefore preferably defined as 0.003%.

Ca and REM are elements that contribute to toughness improvement by controlling formation of MnS and other sulfides. Addition of either or both is therefore preferable. To obtain this effect, Ca is preferably added to a content of 0.001% or greater and REM to a content of 0.002% or greater. However, when Ca addition exceeds 0.01% or REM addition exceeds 0.02%, the cleanliness of the steel may be impaired by formation of large clusters and large inclusions as a result of the generation of Cao—CaS or REM-CaS. It is therefore preferable to set the upper limit of Ca addition at 0.01% and the upper limit of REM addition at 0.02%. The still more preferable upper limit of Ca addition is 0.006%.

The structure of the heat-treated steel pipe will be explained next.

In order to achieve excellent deformation characteristics, particularly to improve pipe expandability and lower yield ratio, the steel pipe is preferably given a two-phase structure comprising, in terms of area fraction, 2 to 10% of MA and the balance of soft phase. On the other hand, when the austenitic ratio increases to 10% or greater during heating in the two-phase region, the austenite decomposes into ferrite and cementite during air cooling because its C concentration becomes insufficient. Realizing MA of greater than 10% is therefore difficult.

After leveling by etching, MA looks white when observed with a light microscope. Moreover, when a sample subjected to nital etching is observed with a scanning electron microscope (SEM), the MA, which is resistant to the etching, is observed as a structure present in the form of flat islands. The MA area fraction can therefore be measured by image analysis of a light microscope structure micrograph of a sample leveled by etching or of an SEM structure micrograph of the structure of a nital etched sample.

Deformation characteristics, particularly pipe expandability, improve as work hardening is easier. Excellent pipe expandability can therefore be achieved by establishing an MA area fraction of 2 to 10% so as to make the work-hardening coefficient in the circumferential direction of the steel pipe of 0.10 or greater.

Portions other than the MA are soft phases, namely, the ferrite, martensite and bainite structures of the steel pipe before heat treatment after being heated at $Ac_1$+10° C. to $Ac_1$+60° C., preferably $Ac_1$+20° C. to $Ac_1$60° C., and then air cooled.

In the present invention, the martensite and bainite softened by heating to $Ac_1$+10° C. to $Ac_1$+60° C., preferably $Ac_1$+20° C. to $Ac_1$+60° C., and air cooling are high-temperature tempered martensite and high-temperature tempered bainite. In other words, the soft phase is one or more ferrite, high-temperature tempered martensite, and high-temperature tempered bainite.

$Ac_1$ of a steel in the composition range of the invention can be calculated using the following equation:

$$Ac_1=723+29.1\times Si-10.7\times Mn-16.9\times(Ni—Cr),$$

where Si, Mn, Ni and Cr represent the contents (mass %) of the associated elements.

$Ac_1$ can also be determined experimentally using a specimen taken from the produced steel plate or a steel of the same composition produced in the laboratory. For example, the transformation temperature during steel heating can be determined by the so-called Formaster test of heating the test piece at a constant rate and measuring expansion.

The austenite transformation start temperature ($Ac_1$) and austenite transformation end temperature ($Ac_3$) can be found by determining the temperatures of the start and end points of the bend from the relationship between temperature and expansion ascertained by the Formaster test.

Ordinarily, when a steel is heated from $Ac_1$ to $Ac_3$, some martensite, bainite and ferrite transforms to austenite and the remainder progressively recovers to body-centered cubic structure as is.

Of particular note regarding the production method of the present invention is that since the heating is performed in the relatively low temperature zone of $Ac_1$+10° C. to $Ac_1$+60° C., preferably $Ac_1$+20° C. to $Ac_1$+60° C., much of the martensite and bainite present before the heating does not transform to austenite but remains as soft phase as though having undergone tempering. In other words, when the martensite and bainite formed in the steel pipe before heat treatment is heated at $Ac_1$+10° C. to $Ac_1$+60° C., preferably $Ac_1$+20° C. to $Ac_1$+60° C., they soften owing to dislocation recovery and precipitation of solute C, thereby becoming high-temperature tempered martensite and high-temperature tempered bainite.

The ferrite includes some that was also ferrite before heating and progressively recovered during heating, and some that transformed to austenite during heating at $Ac_1$+10° C. to $Ac_1$+60° C., preferably $Ac_1$+20° C. to $Ac_1$+60° C., and then reverse-transformed during air cooling. In other words, ferrite and cementite from ferrite decomposition are mixed together. However, the two are collectively called ferrite because it is difficult to distinguish them with a light microscope.

The steel pipe excellent in deformation characteristics of the present invention having the aforesaid composition and metallurgical structure has a tensile strength of 500 to 900 MPa and a wall thickness of 5 mm to 20 mm. Particularly in the case of a steel pipe for expandable-pipe oil well, tensile strength of 550 to 900 MPa and thickness of 5 mm to 15 mm, preferably 7 mm to 15 mm are required. In a low-yield-ratio line pipe, tensile strength of 500 to 750 MPa and thickness of 5 mm to 20 mm are required.

The production conditions for the steel pipe excellent in deformation characteristics having the aforesaid composition will be explained next. The method of producing the steel pipe excellent in deformation characteristics of the present invention consists in heat treating a precursor steel pipe without subjecting it to diameter-reduction rolling or other hot working. However, sizing for roundness improvement or cold working for shape correction can be conducted before the heat treatment.

The method of producing the steel pipe excellent in deformation characteristics according to the present invention is basically characterized by the production conditions explained in the foregoing, namely, by heat treating a precursor steel pipe at $Ac_1$+10° C. to $Ac_1$+60° C., preferably $Ac_1$+20° C. to $Ac_1$+60° C. and subsequent air cooling. The present invention therefore enables improvement of deformation characteristics solely by air cooling after heat treating the precursor steel pipe throughout, thus eliminating the need for water cooling requiring large-scale heat treatment equipment. Worth noting is that water cooling after the heat treatment produces martensite, not MA. The pipe heat treatment temperature is specified as $Ac_1$+10° C. to $Ac_1$+60° C., preferably $Ac_1$+20° C. to $Ac_1$+60° C., in order to form MA after air cooling. This formation of MA occurs because when partial transformation to austenite occurs upon heating to the two-phase region, C concentrates in the austenite, with substantially no distribution of other elements therein.

More specifically, when the heating temperature is less than $Ac_1$+10° C., the low rate of transformation to austenite makes it difficult to obtain the desired amount of MA. For increasing the amount of austenite formed during heating, the heating temperature is preferably made $Ac_1$+20° C. or greater. On the other hand, when heating is performed at a temperature exceeding $Ac_1$+60° C., the amount of transformation to austenite becomes too great. As this makes the C concentration in the austenitic phase insufficient, the air cooling decomposes the austenite into ferrite and cementite, making it hard to obtain enough MA. Further, the upper limit of the heating temperature is preferably defined as 780° C. or less to ensure fine grain diameter. The chemical composition of the steel pipe is therefore preferably defined so that $Ac_1$ is 720° C. or less.

Although any production method can be used to produce the invention steel pipe excellent in deformation characteristics (e.g., steel pipe for expandable-pipe oil well or low-yield-ratio line pipe), a method that minimizes thickness unevenness is preferable. If thickness unevenness is small, even a seamless pipe suffices. However, a welded pipe is generally fabricated by butt-welding a steel plate hot rolled to high plate thickness accuracy and is therefore lower in thickness unevenness than a seamless pipe.

As the method for forming the welded pipe, it suffices to adopt an ordinarily used pipe forming method, namely, press forming or roll forming. Although laser welding, arc welding or electric-resistance-welding can be used as the butt-welding method, the high productivity of the electric resistance welding process makes it especially suitable for fabricating the invention steel pipe, and particularly for the invention oil well pipe and line pipe.

The hot-rolled plate is obtained by hot rolling a steel slab in the austenite region, then conducting rough rolling followed by finish rolling. Forced cooling is preferably performed after the finish rolling. The steel plate that is the starting material preferably has a tensile strength of 600 to 800 MPa.

The hot rolling temperature is preferably made 1000° C. or greater to ensure that the slab assumes an austenitic structure with good hot workability. But at a hot rolling temperature greater than 1270° C., the structure coarsens to impair hot workability. The upper limit of the hot rolling temperature is therefore preferably defined as 1270° C.

The finish rolling is preferably performed at a reduction of 50% or greater in order to refine the grain diameter of the pipe. The finish rolling reduction is determined by dividing the difference in plate thickness between before and after rolling by the plate thickness before rolling. When the finish rolling is conducted at a reduction of 50% or greater, austenite is formed and dispersed uniformly during heating of the steel pipe in the two-phase region, thereby finely dispersing MA and improving the pipe expansion characteristics.

Forced cooling performed following finish rolling gives the hot-rolled plate a multiphase structure including ferrite, martensite, and bainite. (The most common multiphase structure is one of ferrite and bainite.) The desired multiphase structure can be established by, for example, following the finish rolling with cooling at 15° C./s and coiling at 400 to 500° C. This ensures even more uniform dispersion of austenite during heating of the pipe in the two-phase region. As MA therefore disperses finely, the deformation characteristics are enhanced, with particular improvement of expansion characteristics and reduction of yield ratio.

Among the steel pipes excellent in deformation characteristics obtained by the invention production method, the steel pipe for expandable oil well can be inserted into a well drilled in the ground using a drill pipe or into a well in which another oil well pipe is already installed. Wells sometimes reach a depth of several thousand meters. The steel pipe for expandable oil well that is expanded inside the well preferably has a wall thickness of 5 to 15 mm and outside diameter of 114 to 331 mm.

In the case of laying the low-yield-ratio line pipe obtained by the invention production method on the seabed to build a submarine pipeline, it is possible to employ the reel barge method. The line pipe is preferably an electric-resistance-welded pipe, and preferably has a wall thickness of 5 to 20 mm and an outside diameter of 114 to 610 mm.

EXAMPLE 1

Steels containing the chemical compositions shown in Table 1 were produced in a converter and continuously cast into slabs. Each of the obtained slabs was heated to 1100 to 1200° C., rolled with a continuous hot-rolling mill at a reduction of 70% or greater, cooled at 10 to 20° C./s, and coiled at 400 to 500° C. to produce a 9.56-mm thick hot-rolled plate.

The hot-rolled plate was used as a material for producing a steel pipe of 193.7-mm outside diameter by the electric resistance pipe welding process. The obtained pipe was heated for 120 s at the temperature shown in Table 2 and then subjected to air-cooling heat treatment. The symbol "0" in Table 1 means that addition of the optional element was intentionally omitted.

A specimen taken along the circumference of the pipe was tensile-tested to determine yield strength (YS), tensile strength (TS) and work-hardening coefficient (n value). A log-log graph of true strain vs true stress was prepared, and the n value was determined from the slope of the linear section. A pipe expansion test of expanding the pipe 30% was conducted at one end of the pipe using a plug. After the expansion, the wall thickness distribution of the expanded pipe was measured. The difference relative to the average wall thickness was calculated and the maximum wall thickness loss value was used an index of maximum wall thickness loss.

The structure of the steel pipe was observed with a light microscope. The area fraction of the MA was determined by image analysis of a microstructure photograph of a sample that had been leveled by etching. The portion other than MA consisted of ferrite, martensite and bainite. Vickers hardness measurement confirmed that martensite and bainite had softened.

The results are shown in Table 2. In Table 2, YS/TS (yield ratio) is the ratio of yield strength to tensile strength (Y/T) expressed in percent. It is clear from Table 2 that the invention steel pipes experienced only small maximum wall thickness loss on the order of around 0.6 mm or less and exhibited excellent expansion characteristics equal to or better than Example No. 7 in which water cooling was performed. Note that Example No. 7 is a Comparative Example that did not satisfy Mn+Cr+Ni+2Mo+Cu≥2.00 and used water cooling. The symbol (9) indicated for Example No. 7 in the MA area fraction column means that the area fraction of martensite formed during water cooling after pipe heating was 9%.

In Example No. 6 the heating temperature was too high and in Example No. 8, as in Example No. 7, the steel composition was outside the ranges specified by the present invention. In these Examples, MA formation after air cooling was insufficient and large wall thickness loss of greater than 1 mm occurred.

TABLE 1

| Steel | Chemical composition (Mass %) C | Si | Mn | P | S | Al | N | Ni | Mo | Cr | Cu | Nb |
|---|---|---|---|---|---|---|---|---|---|---|---|---|
| A | 0.06 | 0.24 | 1.84 | 0.014 | 0.002 | 0.03 | 0.004 | 0.18 | 0.11 | 0.02 | 0.32 | 0.04 |
| B | 0.08 | 0.12 | 1.56 | 0.007 | 0.001 | 0.05 | 0.005 | 0.48 | 0.08 | 0 | 0 | 0 |
| C | 0.05 | 0.45 | 1.61 | 0.009 | 0.002 | 0.04 | 0.002 | 0.17 | 0 | 0.15 | 0.31 | 0.02 |
| D | 0.06 | 0.08 | 1.94 | 0.012 | 0.003 | 0.03 | 0.003 | 0 | 0.16 | 0 | 0 | 0 |
| E | 0.07 | 0.11 | 2.01 | 0.016 | 0.002 | 0.06 | 0.003 | 0 | 0 | 0.32 | 0 | 0.03 |
| F | 0.07 | 0.21 | 1.45 | 0.011 | 0.003 | 0.02 | 0.004 | 0.11 | 0 | 0 | 0 | 0.04 |

| Steel | Chemical composition (Mass %) V | Ti | B | Ca | REM | Mn + Cr + Ni + 2Mo + Cu | $Ac_1$ ° C. | Remark |
|---|---|---|---|---|---|---|---|---|
| A | 0.05 | 0.015 | 0 | 0 | 0 | 2.58 | 708 | Invention |
| B | 0 | 0 | 0 | 0.003 | 0 | 2.2 | 702 | |
| C | 0 | 0.012 | 0 | 0 | 0 | 2.24 | 719 | |
| D | 0.03 | 0.014 | 0.0012 | 0 | 0 | 2.26 | 705 | |
| E | 0 | 0.008 | 0 | 0 | 0.008 | 2.33 | 710 | |
| F | 0 | 0.016 | 0 | 0 | 0 | 1.56 | 712 | Comparative |

Underlined value is outside scope of invention.

$Ac_1 = 723 + 29.1 \times Si - 10.7 \times Mn - 16.9 \times (Ni - Cr)$

TABLE 2

| Example No. | Steel | $Ac_1$ + 10° C. | $Ac_1$ + 60° C. | Heat temp ° C. | Cooling method | MA area fraction % | YS MPa | TS MPa | Y/T % | N value | Max thickness loss mm | Remark |
|---|---|---|---|---|---|---|---|---|---|---|---|---|
| 1 | A | 718 | 768 | 760 | Air | 5 | 565 | 778 | 72.6 | 0.14 | 0.61 | Invention |
| 2 | B | 712 | 762 | 750 | Air | 6 | 491 | 760 | 64.6 | 0.16 | 0.52 | |
| 3 | C | 729 | 779 | 750 | Air | 7 | 505 | 758 | 66.6 | 0.17 | 0.48 | |
| 4 | D | 715 | 765 | 750 | Air | 5 | 499 | 698 | 71.5 | 0.13 | 0.55 | |
| 5 | E | 720 | 770 | 760 | Air | 4 | 512 | 714 | 71.7 | 0.13 | 0.59 | |
| 6 | A | 718 | 768 | 820 | Air | 1 | 571 | 667 | 85.6 | 0.08 | 1.21 | Comparative |
| 7 | F | 722 | 772 | 760 | Water | (9) | 433 | 640 | 67.7 | 0.15 | 0.55 | |
| 8 | F | 722 | 772 | 760 | Air | 0 | 450 | 522 | 86.2 | 0.09 | 1.16 | |

Underlined items are outside scope of invention.

In Example No. 7, value in parentheses in area fraction column is martensite area fraction.

EXAMPLE 2

Steels containing the chemical compositions shown in Table 3 were produced in a converter and continuously cast into slabs. Each of the obtained slabs was heated to 1100 to 1200° C., rolled with a continuous hot-rolling mill at a reduction of 70% or greater, cooled at 10 to 20° C./s, and coiled at 500 to 600° C. to produce a 16-mm or 8 mm thick hot-rolled plate. The hot-rolled plate was used as a material for producing a steel pipe of 400-mm outside diameter by the electric resistance pipe welding process. A specimen taken from the pipe prior to heat treatment was tensile-tested and the yield ratio (Y/T) was evaluated.

The obtained pipe was heated for 120 s at the temperature shown in Table 4 and then subjected to air-cooling heat treatment. The symbol "0" appearing in an element column of Table 3 means that addition of the optional element was intentionally omitted. A specimen taken along the length of the pipe was tensile-tested to determine yield strength (YS) and tensile strength (TS). Toughness was evaluated from ductile-brittle transition temperature (Trs) determined by Vickers impact testing.

The structure of the steel pipe was observed with a light microscope. The area fraction of the MA was determined by image analysis of a microstructure photograph of a sample that had been leveled by etching. The portion other than MA consisted of ferrite, martensite and bainite. Vickers hardness measurement confirmed that martensite and bainite had softened.

The results are shown in Table 4. In Table 4, YS/TS (yield ratio) is the ratio of yield strength to tensile strength (Y/T). It is clear from Table 4 that all of the invention steel pipes of Example Nos. 11 to 20 had post-heat-treatment yield ratios of 0.9 or less, a level enabling application in the reel barge method. When the wall thickness to outside diameter ratio was low, as in Example No. 20, work hardening during pipe making was low and yield ratio before heat treatment was also low.

Example Nos. 21 to 24 are Comparative Examples. In Example No. 21, the heating temperature was too high, and in Example No. 22, the heating temperature was too low. In these Examples, the decrease in yield ratio was inadequate owing to insufficient MA formation. Example Nos. 23 and 24 did not satisfy Mn+Cr+Ni+2Mo+Cu≥2.00, so that hardenability was inadequate. Although low yield ratio was achieved with water cooling, yield ratio did not decrease sufficiently with air cooling. The symbol (8.0) indicated for Example No. 23 in the MA area fraction column means that the area fraction of martensite was 8.0%.

TABLE 3

| Steel | Chemical composition (Mass %) C | Si | Mn | P | S | Al | N | Ni | Mo | Cr | Cu | Nb |
|---|---|---|---|---|---|---|---|---|---|---|---|---|
| AA | 0.06 | 0.21 | 1.76 | 0.013 | 0.002 | 0.03 | 0.005 | 0.31 | 0.09 | 0.03 | 0.30 | 0.05 |
| AB | 0.08 | 0.15 | 1.58 | 0.007 | 0.001 | 0.04 | 0.005 | 0.48 | 0.08 | 0 | 0 | 0.03 |
| AC | 0.05 | 0.43 | 1.63 | 0.009 | 0.002 | 0.03 | 0.003 | 0.17 | 0 | 0.15 | 0.31 | 0.03 |
| AD | 0.06 | 0.08 | 1.93 | 0.011 | 0.003 | 0.04 | 0.003 | 0 | 0.16 | 0 | 0 | 0.04 |
| AE | 0.07 | 0.12 | 2.01 | 0.014 | 0.003 | 0.06 | 0.003 | 0 | 0 | 0.32 | 0 | 0.03 |
| AF | 0.08 | 0.23 | 1.18 | 0.009 | 0.002 | 0.04 | 0.002 | 0.23 | 0.24 | 0 | 0.32 | 0.05 |
| AG | 0.07 | 0.21 | 2.20 | 0.015 | 0.001 | 0.03 | 0.003 | 0 | 0 | 0 | 0 | 0.03 |
| AH | 0.07 | 0.21 | 1.45 | 0.011 | 0.003 | 0.02 | 0.004 | 0.11 | 0 | 0 | 0 | 0.04 |

| Steel | Chemical composition (Mass %) V | Ti | B | Ca | REM | Mn + Cr + Ni + 2Mo + Cu | $Ac_1$ ° C. | Remark |
|---|---|---|---|---|---|---|---|---|
| AA | 0.07 | 0.013 | 0 | 0 | 0 | 2.58 | 706 | Invention |
| AB | 0 | 0 | 0 | 0.003 | 0 | 2.22 | 702 | |
| AC | 0 | 0.012 | 0 | 0 | 0 | 2.26 | 718 | |
| AD | 0.03 | 0.014 | 0 | 0 | 0 | 2.25 | 705 | |
| AE | 0 | 0.010 | 0 | 0 | 0.008 | 2.33 | 710 | |
| AF | 0.06 | 0.012 | 0 | 0 | 0 | 2.21 | 713 | |
| AG | 0 | 0.012 | 0 | 0 | 0 | 2.20 | 706 | |
| AH | 0 | 0.016 | 0 | 0 | 0 | 1.56 | 712 | Comparative |

Underlined value is outside scope of invention.

$Ac_1 = 723 + 29.1 \times Si - 10.7 \times Mn - 16.9 \times (Ni - Cr)$

TABLE 4

| Example No. | Steel | Thickness/ Outside diameter | Before heat treatment Y/T (%) | $Ac_1$ + 10° C. | $Ac_1$ + 60° C. | Heat temp ° C. | Cooling method | MA area fraction % | YS MPa | TS MPa | Y/T ° C. | Trs ° C. | Remark |
|---|---|---|---|---|---|---|---|---|---|---|---|---|---|
| 11 | AA | 0.04 | 95 | 716 | 766 | 740 | Air | 4.5 | 555 | 778 | 71.3 | −50 | Invention |
| 12 | AA | 0.04 | 95 | 716 | 766 | 730 | Air | 4.0 | 545 | 765 | 71.2 | −50 | |
| 13 | AA | 0.04 | 95 | 716 | 766 | 760 | Air | 5.5 | 531 | 781 | 68.0 | −50 | |
| 14 | AB | 0.04 | 96 | 712 | 762 | 740 | Air | 3.5 | 482 | 762 | 63.3 | −55 | |
| 15 | AC | 0.04 | 94 | 728 | 778 | 740 | Air | 3.5 | 501 | 757 | 66.2 | −50 | |
| 16 | AD | 0.04 | 96 | 715 | 765 | 740 | Air | 4.0 | 487 | 685 | 71.1 | −50 | |
| 17 | AE | 0.04 | 95 | 720 | 770 | 750 | Air | 4.0 | 514 | 711 | 72.3 | −50 | |
| 18 | AF | 0.04 | 96 | 723 | 773 | 740 | Air | 3.0 | 525 | 739 | 71.0 | −50 | |
| 19 | AG | 0.04 | 96 | 716 | 766 | 740 | Air | 3.5 | 534 | 742 | 72.0 | −50 | |
| 20 | AA | 0.02 | 82 | 716 | 766 | 740 | Air | 5.0 | 568 | 782 | 72.6 | −50 | |
| 21 | AA | 0.04 | 95 | 716 | 766 | 790 | Air | 1.0 | 608 | 712 | 85.4 | −55 | Comparative |
| 22 | AA | 0.04 | 95 | 716 | 766 | 700 | Air | 0 | 645 | 715 | 90.2 | −65 | |
| 23 | AH | 0.04 | 96 | 722 | 772 | 750 | Water | (8.0) | 434 | 622 | 69.8 | −50 | |
| 24 | AH | 0.04 | 96 | 722 | 772 | 750 | Air | 0 | 454 | 533 | 85.2 | −50 | |

Underlined items are outside scope of invention.

In Example No. 23, value in parentheses in area fraction column is martensite area fraction.

Industrial Applicability

As set forth in the foregoing, the present invention enables low-cost production of a steel pipe excellent in deformation characteristics, most notably of a steel pipe for expandable-pipe oil well and a low-yield-ratio line pipe. The present invention therefore makes a very considerable contribution to industry.

What is claimed is:

1. A cold-formed, electric-resistance-welded steel pipe excellent in deformation characteristics consisting of, in mass %

C: 0.04 to 0.10%

Mn: 1.00 to 2.50%,

Si: 0.80% or less,

P: 0.03% or less,

S: 0.01% or less,

Al: 0.10% or less, and

N: 0.01% or less, one or more of

Mo: 0.60% or less,

Cr: 1.00% or less,

Cu: 1.00% or less,

V: 0.30% or less,

B: 0.0003 to 0.003%,

Ca: 0.01% or less, or

REM: 0.02% or less, one or more of

Ni: 1.00% or less,

Nb: 0.01 to 0.30%, or

Ti: 0.005 to 0.03%, and a balance of iron and unavoidable impurities, and wherein the cold-formed, electric-resistance-welded steel pipe has an outer diameter of 114 to 610 mm, a wall thickness of 5 to 15 mm, and a ratio of wall thickness to outer diameter of 0.03 or greater, wherein a content of Mn and a content of one or more of Cr, Ni, Mo and Cu satisfy $$Mn+Cr+Ni+2Mo+Cu \geq 2.00, \text{ and}$$

wherein the cold-formed, electric-resistance-welded steel pipe has two-phase microstructure in the entire steel pipe consisting of a martensite-austenite phase having an area fraction of 2 to 10%, and a soft phase comprising at least one of a high-temperature tempered martensite and a high-temperature tempered bainite, wherein the martensite-austenite phase, the high-temperature tempered martensite and the high-temperature tempered bainite are obtained by heat treatment at a temperature of $Ac_1+10°$ C to $Ac_1+60°$ C and air-cooling, and wherein the cold-formed, electric-resistance-welded steel pipe has a work-hardening coefficient in the circumferential direction of 0.10 or greater.

* * * * *

UNITED STATES PATENT AND TRADEMARK OFFICE

CERTIFICATE OF CORRECTION

PATENT NO. : 8,920,583 B2
APPLICATION NO. : 12/452765
DATED : December 30, 2014
INVENTOR(S) : Hitoshi Asahi et al.

It is certified that error appears in the above-identified patent and that said Letters Patent is hereby corrected as shown below:

Specification

Column 1, line 8, change "filed 23, Jul. 2007;" to -- filed 23 Jul. 2007; --;

Column 4, line 46, change "Ti: 0.0.05 to 0.03%," to -- Ti: 0.005 to 0.03%, --;

Claims

Column 15, lines 60-61, change "in mass%" to -- in mass%: --; and

Move "N: 0.01% or less," from Column 16, line 25 (above TABLE 4) to Column 16, line 48, which is above "one or more of.".

Signed and Sealed this
Twenty-seventh Day of October, 2015

Michelle K. Lee

Michelle K. Lee
*Director of the United States Patent and Trademark Office*